United States Patent [19]

Ryan et al.

[11] Patent Number: 4,911,827

[45] Date of Patent: Mar. 27, 1990

[54] GRASS SEED CLEANER

[75] Inventors: Danny L. Ryan, P.O. Box 177, Abernathy, Tex. 79311; Dan R. Field, P.O. Box 1105, Lovington, N. Mex. 88260

[73] Assignees: Danny L. Ryan; Dan R. Field; Mike T. Field, all of Lubbock, Tex.

[21] Appl. No.: 201,733

[22] Filed: Jun. 2, 1988

[51] Int. Cl.[4] ..... B07B 1/10

[52] U.S. Cl. ..... 209/235; 209/308; 209/390; 209/700

[58] Field of Search ..... 209/235, 307, 308, 385, 209/386, 389, 390, 627, 684, 685, 686, 625, 2, 384, 681, 700, 382, 255, 401

[56] References Cited

U.S. PATENT DOCUMENTS

| | | | |
|---|---|---|---|
| 625,295 | 5/1899 | Elder et al. | 209/307 |
| 710,981 | 10/1982 | Jessup | 209/308 |
| 1,657,414 | 1/1928 | Silver | 209/308 |
| 2,069,139 | 1/1937 | Flather | 209/308 X |
| 2,115,107 | 4/1938 | Hoffeld | 209/307 |
| 2,226,009 | 12/1940 | Miller | 209/307 |
| 2,614,691 | 10/1952 | Slayter | 209/45 X |
| 3,110,665 | 11/1963 | Gustafson | 209/308 X |
| 4,535,894 | 8/1985 | Shell | 209/307 X |

FOREIGN PATENT DOCUMENTS

| | | | |
|---|---|---|---|
| 1057375 | 3/1954 | France | 209/307 |
| 425662 | 7/1972 | U.S.S.R. | 209/307 |

*Primary Examiner*—Donald T. Hajec
*Attorney, Agent, or Firm*—Wendell Coffee

[57] ABSTRACT

Fluffy grass seed with accompanying coarse trash and fine trash are placed upon the top of a vibrating screen. The fluffy grass seed are enmeshed in the meshes of the screen while the fine trash falls through the screen and the coarse trash is loose upon the top of the screen. The coarse trash is dumped from the screen by inverting the screen. Thereafter the fluffy seed are doffed from the screen by brushes.

12 Claims, 2 Drawing Sheets

GRASS SEED CLEANER

RIGHTS TO INVENTIONS UNDER FEDERAL RESEARCH:

There was no federally sponsored research and development concerning this invention.

BACKGROUND OF THE INVENTION:

1. Field of the Invention

This invention relates to seed cleaning, and more particularly to cleaning a particular type of grass seed known as fluffy seed.

2. Description of the Related Art

In recent times, there has been a great revival to plant certain grasses that were native to the North American continent. These grasses are called either native grasses or range grasses and included the following specific grasses:

All of the Bouteloua which are known as the Grama family such as Bouteloua Curipendula (Sideoats Grama), Bouteloua Gracilis (Blue Grama), and also the other gramas commonly known as black grama and premier grama.

All of the Andropogon which are known as the Bluestem family such as Andropogon scoparium (Little Bluestem), Andropogon Hallii (Sand Bluestem), and also the other bluestems commonly known as King Ranch; Plains; WW Spar; Ganada; Old World: T-587; Caucasian; Kaw (Big); Elida and Woodward (Sand); and Cimmaron, Pastura, and Native Mix (Little).

Also, Sorghastrum Nutans known as Indiangrass.

The above list is by way of example and by no means meant to be inclusive.

In planting grass seed, it is desirable to plant the seed in their husk. In general in this application, when the term "seed" is used, it is meant the caryopsis with husk. It is difficult to plant the seed either with fine trash or with coarse trash because of the nature of grass planting devices that are commercially available.

Before this invention, the seed could be cleaned so that only about 20% of the material by weight was caryopsis. After this invention, the seed are cleaned so that 50% of the material by weight caryopsis. Actually about 98% of the material after cleaning are the seed with seed husk attached. The seed husk account for approximately the same amount of weight as the caryopsis themselves. Since it is desirable to plant the seed with the husk, this is a very high degree of cleaning, considering that inasmuch as before this invention over half of the material delivered to the farmer for planting would be trash, either trash that was larger than the seed or trash that was smaller and finer than the seed, both of which were detrimental to the seeding process through the seeders which were commercially available to the farmer.

The seed of the grasses listed above are known as fluffy seed. This is because of the particular shape of the seed husk and the covering on the seed husk by which they can be distributed by the wind and the fur and coats of animals.

Cleaning fluffy seeds present particular problems. All of these seeds are very small and none of them have a thickness of more than $\frac{1}{8}''$ and most of them have a thickness of far less than $\frac{1}{8}''$. Because they have the husk on them to be carried by the wind, they are as easily carried by the trash that is sought to be separated from them.

The caryopsis will be over 100,000 seed per pound.

Before this application was filed, applicant was familiar with RICH, #491,594 issued in 1893; RICHARDSON, #609,212 issued in 1898; WALSH, #660,232 issued in 1900; and PERKINS #1,675,049 issued in 1928. It is applicant's understanding that all of these patents have pockets, recesses, cells, or indentation wherein oat seed or grains will fit but other grains and trash will not; and therefore, uses them for cleaning purposes.

Also, GREEN, #1,019,041 issued in 1912, is understood to operate on the same principle as the four patents listed above. However, GREEN does use a wire cloth.

Prior to the invention described herein, seed were basically cleaned by two methods, either sifting or scalping.

By sifting seed, it is meant that the seed were placed on a screen, the mesh of which was smaller than the thickness of the seed; and therefore, the seed would ride on top of the screen, and foreign material would pass through the screen.

By scalping seed, it is meant that the mesh of the screen was larger than the seed and the seed would drop through the holes or mesh in the screen, and the foreign material would stay on top of the screen.

SUMMARY OF THE INVENTION:

1. Progressive Contribution to the Art

This invention utilizes the natural trait of the fluffy seed to become entangled. Specifically, this invention works upon enmeshing the seed into the mesh or openings of a screen. With the seed so entrapped, trash that is smaller than the seed falls through the mesh while the trash that is larger than the seed ride on top. In such a situation, if the screen is mounted upon a pair of rollers so that the screen has a top run and a bottom run, if the seed are placed upon the top run, the fine trash will fall through the top run and be collected by a tray immediately below the top run. As the screen is turned from the top run to the bottom run over a roller, the trash on top of the screen will fall off and be discarded. The seed, being enmeshed in the screen, will hang to the mesh while it is along the bottom run. There it may be doffed from the screen by brushing the screen.

It is beneficial to vibrate or bounce the top run. This is done by training the screen or diverting the screen slightly by a shaft carrying diametrically opposite beaters so that as the shaft is rotated, the beaters will cause the screen to vibrate raising the screen twice with each revolution and dropping it twice with each revolution. This bouncing of the screen both aids in the fine materials falling through the screen and the enmeshing the seed within the mesh of the screen.

2. Objects of this Invention

An object of this invention is to clean fluffy seed.

Further objects are to achieve the above with devices that are sturdy, compact, durable, lightweight, simple, safe, efficient, versatile, ecologically compatible, energy conserving, and reliable, yet inexpensive and easy to manufacture, adjust, operate and maintain.

Other objects are to achieve the above with a method that is rapid, versatile, ecologically compatible, energy conserving, efficient, and inexpensive, and does not require highly skilled people to adjust, operate and maintain.

The specific nature of the invention, as well as other objects, uses, and advantages thereof, will clearly appear from the following description and from the accompanying drawing, the different views of which are not scale drawings.

Figure 1:
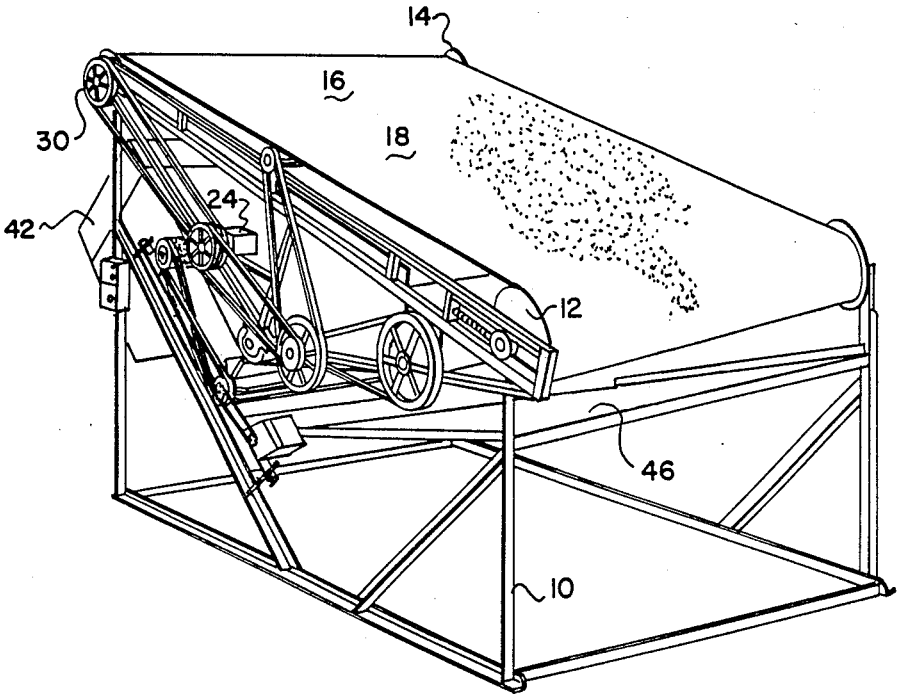
FIG. 1 is a perspective view of a cleaner according to this invention.

As an aid to correlating the terms of the claims to the exemplary drawing, the following catalog of elements and steps is provided:

10 frame
12 lower roller
14 upper roller
16 screen
18 top run
20 bottom run
22 hopper
24 screen motor
28 sheave
30 sheave
32 fine trash tray
34 auger conveyor
36 paddle shaft
38 paddles
40 sheave
42 coarse trash tray
44 upper seed tray
46 lower seed tray
48 carpet doff brush
50 carpet
52 sheave
53 brush motor
54 bristle doff brush
58 sprocket
60 backing rollers
62 brush frame
64 adjust bolts
66 threads
U - distal fuzzy portion
L - lower fuzzy portion

DESCRIPTION OF THE PREFERRED EMBODIMENT:

Referring to the drawing, there may be seen that a seed cleaner according to this invention includes frame 10. Lower roller 12 and upper roller 14 are parallel and journaled to frame 10 for rotation about their axis. The rollers are spaced apart from one another horizontally. Screen 16 is trained over the rollers. The screen is in a loop or continuous belt. Since the rollers are horizontally spaced apart, the screen will have an upper run or top run 18 and a lower run or bottom run 20.

Hopper 22 is attached to the frame by supports not shown for clarity. The hopper is located above the top run 18 near the lower roller 12. It extends from about one side of the screen 16 to the other. The hopper 22 is slightly shorter than the length of the rollers 12 and 14. The hopper is means for feeding the seed and trash to the screen 16 to be cleaned.

Screen motor 24 is connected to a variable speed transmission means. The output of the variable speed transmission is connected to v-belt sheave 28. The sheave 28 by suitable belt is connected to sheave 30 upon the upper roller 14 by which the upper roller, and thus, the screen 16 and lower roller 12 are driven. The motor 24, and sheaves 28 and 30 form screen drive means for driving the upper roller, and thus, the screen and lower roller at variable speeds. The preferred speed of the screen is about 120 feed per minute. As may be seen, the screen is driven so that the top run moves upward from the lower roller 12 to the upper roller 14.

Fine trash tray 32 is located beneath the top run 18 of the screen 16 and forms a means for catching the fine trash that fall through the screen. Adjacent to the lower roller 12 is auger conveyor 34 to move the fine trash to one side of the cleaner for disposal.

The upper roller 14 is spaced vertically at a higher elevation than the lower roller 12. It is at about a 30° angle from roller 12; and therefore, the top run 18 of the screen 16 as well as the fine trash tray 32 are also at about a 30° angle to horizontal.

About midpoint of the upper run 20, paddle shaft, is journaled for rotations parallel to each of the rollers 12 and 14. The paddle shaft 36 has a pair of beaters or paddles 38 extending longitudinally thereof, preferable made of wood. The paddle shaft has sheave 40 mounted thereon which is driven from the motor 24 as shown in the drawings. The sheave forms a portion of beater means to rotate the paddle shaft at about 300 revolutions per minute. Since there are two paddles, it may be seen that the paddles will strike or vibrate the upper run of the screen about 600 strokes per minute. I.e., as the screen moves upward, the paddles 38 they will strike the screen 16 about five times each time the screen moves one foot. This vibration of the screen performs at least two functions, one, it helps to bounce the seed upon the screen so that they become enmeshed in the screen. Also, they tend to sift the fine trash through the screen. It will be understood that most of the fine trash will be stems which are somewhat needle shaped. Therefore, they are better sifted through the screen if the screen is bounced. Also, vibration aids in distributing the fine trash and the coarse trash in the seed so that there are no wads or clumps of the coarse trash carried upward with the seed, so that the seed are not exposed to being enmeshed into the screen.

Figure 5:
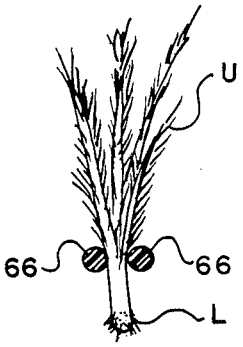
FIG. 5 is a cross-sectional view of a single seed in a single mesh.
Figure 4:
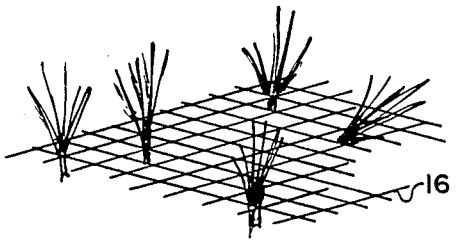
FIG. 4 is a perspective view, schematic in character, showing the seed enmeshed in the screen.

Referring to FIG. 4, it may be seen how the seed will be enmeshed in the screen 16. FIG. 5 is an enlarged cross-sectional view showing threads 66 of the screen 16. There, the husk of the screen is shown with the upper or distal fuzzy portion "U" and the lower fuzzy portion "L".

The fine trash will fall through the screen and slide down the fine trash tray 32 to the auger conveyor 34. The coarse trash on the top of the screen will be carried to the upper roller 14 and will then drop off at the upper roller onto the coarse trash tray 42 where the coarse trash may be disposed of.

The seed as described will be enmeshed in the screen and will be carried around the upper roller to the bottom run. When the term "enmeshed" is used, it is meant that the seed will be caught, captured, snared, ensnared, trapped, entrapped, or entangled, in the mesh of the screen. Also, it will be understood that different grasses have seed that are not the same size. On some varieties such as Little Bluestem (which is illustrated), a screen having a 16×16 mesh is suitable (16×16 means that the threads or wires of the screen are 16 to the inch in both directions). Basically a Nylon screen is preferred because of its adaptability to repeated bending as it travels around the rollers 12 and 14. It also can withstand the constant vibration or beating from the paddles 38. In other cases of grass seed such as Blue Grama or Indiangrass, a smaller screen such as a screen having a 22×22 mesh is desirable. Other seeds, even those not listed above, will be fluffy seeds and require screens of different mesh. It will be understood that the term "mesh" is used to mean the opening or spaces between the threads.

Therefore, it may be seen that once the screen has passed over the upper roller and has changed from the top run 18 to the bottom run 20, the screen at that time only carries seed which are enmeshed therein. Therefore, an upper seed tray 44 extends from beneath the upper roller from the under the bottom run from the upper roller 14 to about midpoint of the bottom. Lower seed tray 46 extends from the lower roller to about the same termination as the upper seed tray. Between the two seed trays there is a gap or opening through which the seed fall the seed may be caught in a trough or conveyor (not shown) to be collected at that point.

The first doffing brush is called carpet doffing brush 48. This is because the brush is in the form of a cylinder with artificial grass outdoor carpet 50 upon it. It lightly brushes against the screen 16, brushing some seed from the screen. The cylinder carrying the carpet doffing brush 48 has sheave 52 thereon. The sheave 52 is driven by brush motor 53 as seen in the drawings. The sheave 52 forms a portion of a brush means for rotating the carpet doffing brush so that the carpet doffing brush has a peripheral speed of about 235 feet per minute. It travels in the same direction as the screen. Therefore, the relative speed between the brush and the screen is about 120 feet per minute. The carpet brush not only doffs some of the seed from the screen, but it also arranges the seed so that they are better doffed by bristle doff brush 54. The bristle doff brush 54 is so called because this doff brush has rows of stick brushes, i.e., bristles applied to a stick. The bristles projecting from this brush are about 1½"–2" in length. Sprocket 58 on the bristle brush is driven by the motor 53 as shown in the drawing. The sprocket 58 forms part of a bristle brush means for rotating the bristle doffing brush so it has a peripheral speed of about 314 feet per minute. It rotates in a direction opposite to the direction of the movement of the screen 16 so there is a relative speed between the bristle brush and the screen of about 430 feet per minute.

It is not necessary that 100% of the seed be doffed by the brushes 48 and 54 from the screen each pass. I.e., if a seed passes by the brushes still enmeshed in the screen, there are not so many seed left in the mesh that prevents other seed from becoming enmeshed as the screen makes the top run 18. As the seed pass by the doffing brushes the next time, a certain percentage of them will be doffed. It has been noted that when the raw product is feed through the hopper 22 and the raw product feed through hopper 22 ceases, it takes as many as four or five additional rotations of the screen by the doffing brushes for substantially all of the seed to be brushed therefrom.

Backing roller 60 is journaled for rotation to the frame 10. It, like the brushes 48 and 54, is parallel to the rollers 12 and 14. The backing roller is opposite or opposed through the screen 16 from the bristle doffing brush 54. It also causes considerable deviation in the screen.

Figure 2:
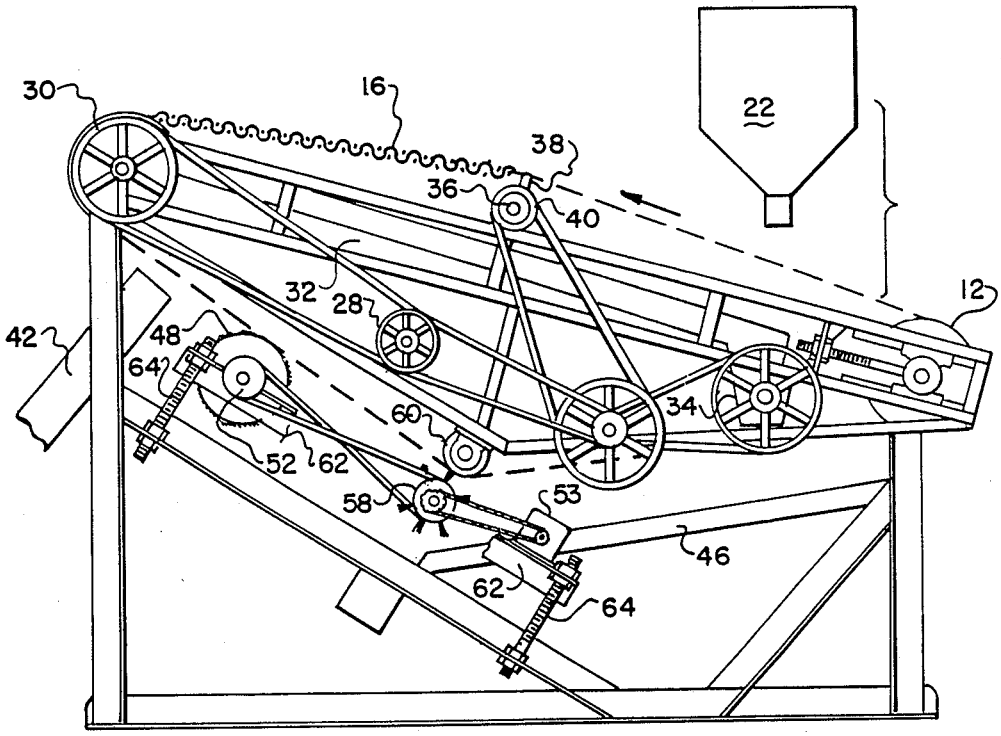
FIG. 2 is a side elevational view, thereof, showing the general arrangements of the screen, and particularly including the drive means for the different rotating elements of the machine.
Figure 3:
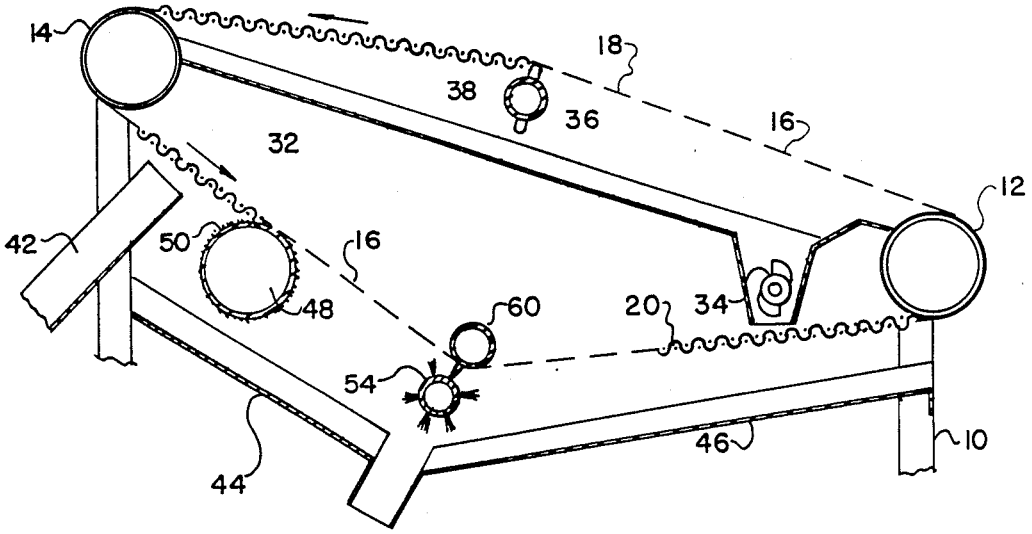
FIG. 3 is a side sectional view of the machine particularly showing the screen, doffing brushes, and trays.

As may be seen, the doffing brushes 48 and 54 are journaled upon brush frame 62, shown broken in FIG. 2. The brush frame 62 is rectangular and is mounted to the frame 10 by adjusting bolts 64. Therefore, the pressure by which each the carpet doffing brush 48 and the bristle doffing brush 54 bear against the screen may be adjusted by adjusting the adjusting bolts 64. Both of the doffing brushes are journaled to the frame 10 through the brush frame 62.

It has been found that the operation of the machine is adversely affected by static electricity. Therefore, it is necessary that the screen be sprayed with antistatic material to prevent the static. Further, it is found that moisture also adversely affects the operation of the machine. Therefore, it is best not to use water as the antistatic material. However, it has been found that almost all commercial antistatic materials tried, except water, work satisfactorily.

The embodiment shown and described above is only exemplary. We do not claim to have invented all the parts, elements or steps described. Various modifications can be made in the construction, material, arrangement, and operation, and still be within the scope of our invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. The method of cleaning fluffy grass seed from its associated trash which contains trash larger and smaller than the fluffy seed comprising:

a. entrapping the fluffy grass seed in the mesh of a woven screen while, b. permitting trash smaller than the fluffy grass seed to fall through the mesh and, c. holding trash larger than the fluffy grass seed on top of the screen, then, d. removing the larger trash from the screen, and then, e. doffing the fluffy grass seed from the screen.

2. The invention as defined in claim 1, further comprising:

f. vibrating the screen to enhance the entrapping step.

3. The invention as defined in claim 1, further comprising:

f. inverting the screen to perform the step of removing the larger trash.

4. The invention as defined in claim 1, wherein the seed are doffed from the screen by first, f. brushing the seed in a first direction at a surface speed relative to the screen of less than 200 feet per minute, and thereafter, g. brushing the seed in a second direction at a speed relative to the screen of greater than 200 feet per minute.

5. The invention as defined in claim 4, further comprising:

h. vibrating the screen to enhance the entrapping step.

6. The invention as defined in claim 5, further comprising:

j. inverting the screen to perform the step of removing the larger trash.

7. Structure for cleaning fluffy grass seed from its associated trash comprising:

a. a frame, b. two rollers journaled on the frame, c. a loop of woven mesh screen trained over the rollers, said screen having a mesh of such size that some trash falls through the screen, some trash remaining on top of the screen, and the fluffy seed are enmeshed in the screen, d. screen drive means on the frame for rotating at least one roller; and thus, the screen, e. said rollers horizontally spaced apart; therefore, forming a top run of the screen and a bottom run of the screen, f. a tray on the frame under the top run of the screen so arranged and constructed to catch the fine trash which falls through the screen, g. a tray on the frame at one roller wherein the top run turns to the bottom run so arranged and constructed to catch the trash on top of the screen, h. doffing means below the bottom run to doff the fluffy seed enmeshed in the screen, i. a carpet brush journaled to the frame below the bottom run of the screen adjacent to one of the rollers, j. brush drive means for rotating the carpet brush so that the carpet brush moves in the direction of travel of the screen at the area where the brush is adjacent to the screen, k. a bristle brush journaled to the frame about midpoint of the bottom run of the screen, and l. said bristle brush forming a portion of bristle brush means for brushing the screen so that the bristle brush moves in a direction opposite to the movement of the screen at the area where the brush is adjacent to the screen.

8. The invention as defined in claim 7, further comprising:

m. a paddle shaft journaled on the frame with diametrically opposed paddles thereon below the top run about the midpoint between the two rollers, n. said paddle shaft being a portion of beater means for vibrating the screen.

9. The invention as defined in claim 8, further comprising:

o. a backing roller journaled to the frame contacting the top side of the bottom run opposite to the bristle brush.

10. The invention as defined in claim 9, wherein:

p. said screen drive means causes the screen to travel about 120 feet per minute, q. said beater means causes the screen to vibrate at about 600 strokes per minute, r. said brush drive means causes the carpet brush to have a surface speed of about 235 feet per minute, and a relative speed to the screen of about 120 feet per minute, s. said bristle brush means causes the bristle brush to have a surface speed of about 450 feed per minute, and a relative speed to the screen of about 570 feet per minute.

11. The invention as defined in claim 9, wherein:

p. said carpet brush is a roller covered with a carpet fabric, and q. said bristle brush is a brush having a plurality of longitudinal brush sticks, each brush stick having bristles of more than 1 inch.

12. The invention as defined in claim 11, wherein:

r. said screen drive means causes the screen to travel about 120 feet per minute, s. said beater means causes the screen to vibrate at about 600 strokes per minute, t. said brush drive means causes the carpet brush to have a surface speed of about 235 feet per minute, and a relative speed to the screen of about 120 feet per minute, u. said bristle brush means causes the bristle brush to have a surface speed of about 450 feed per minute, and a relative speed to the screen of about 570 feet per minute.

* * * * *